US007302785B2

(12) United States Patent
Heuvel et al.

(10) Patent No.: US 7,302,785 B2
(45) Date of Patent: Dec. 4, 2007

(54) PACKAGING MACHINE WITH A MOVABLE CENTERING AND LOWERING DEVICE FOR INSERTING PARTITIONS BETWEEN GROUPS OF BOTTLES OR CANS AND A METHOD OF OPERATION THEREOF

(75) Inventors: Robert Van Den Heuvel, Kleve (DE); Hans-Peter Kuhlmann, Xanten (DE); Lothar Wess, Kleve (DE); Thomas Nitsch, Kleve (DE)

(73) Assignee: KHS Maschinen-und Anlagenbau AG, Dotmund (DE)

( * ) Notice: Subject to any disclaimer, the term of this patent is extended or adjusted under 35 U.S.C. 154(b) by 0 days.

(21) Appl. No.: 11/009,551

(22) Filed: Dec. 10, 2004

(65) Prior Publication Data

US 2005/0235607 A1 Oct. 27, 2005

(30) Foreign Application Priority Data

Dec. 17, 2003 (DE) ..... 103 59 310

(51) Int. Cl.
*B65B 43/30* (2006.01)

(52) U.S. Cl. ..... 53/445; 53/472; 53/157; 53/263; 493/91; 493/912

(58) Field of Classification Search ..... 53/445, 53/448, 472, 474, 48.1, 157, 534, 543, 237, 53/238, 249, 251, 258, 263; 493/90, 91, 493/312, 912

See application file for complete search history.

(56) References Cited

U.S. PATENT DOCUMENTS 3,190,048 A * 6/1965 Ganz ..... 53/445
3,257,002 A * 6/1966 Pearson ..... 493/312
3,350,836 A * 11/1967 Dillon et al. ..... 53/67
3,473,295 A * 10/1969 Nigrelli et al. ..... 53/393
3,483,802 A * 12/1969 Heyne ..... 493/91
3,621,765 A * 11/1971 Sootheran et al. ..... 493/91
3,651,614 A * 3/1972 Corderoy ..... 53/474
3,678,647 A * 7/1972 Corderoy ..... 53/435
3,803,993 A * 4/1974 Graham ..... 493/90
3,872,647 A * 3/1975 Langen et al. ..... 53/157
3,924,385 A * 12/1975 Walter ..... 53/48.1
3,952,633 A * 4/1976 Nakai ..... 493/91
4,829,747 A * 5/1989 Johnson et al. ..... 53/457
4,962,625 A * 10/1990 Johnson et al. ..... 53/157
5,485,713 A * 1/1996 Moncrief ..... 53/445
5,600,936 A * 2/1997 Moncrief et al. ..... 53/263
5,713,403 A * 2/1998 Clusserath et al. ..... 141/101
5,862,648 A * 1/1999 Greenwell et al. ..... 53/445
6,128,886 A * 10/2000 Johnson et al. ..... 53/445
2004/0237469 A1 * 12/2004 Serras Vila ..... 53/263

FOREIGN PATENT DOCUMENTS

DE 23 56 319 5/1975
DE 30 33 773 A1 5/1982
DE 40 34 639 A1 5/1991
WO WO 98/43880 10/1998
WO WO 2003037723 A1 * 5/2003

OTHER PUBLICATIONS

European Patent Office Search Report EP 04 02 7821 and English translation thereof.

* cited by examiner

*Primary Examiner*—Stephen F. Gerrity
(74) *Attorney, Agent, or Firm*—Nils H. Ljungman & Associates

(57) ABSTRACT

A packaging machine with a movable centering and lowering device for inserting partitions between groups of bottles or cans and a method of operation thereof. The movable centering and lowering device is designed to move with a group of bottles or cans and insert a divider between the bottles or cans in the group as the group moves through the packaging machine. The movable centering and lowering device is also adjustable to permit handling of dividers of different size and configuration.

20 Claims, 4 Drawing Sheets

PACKAGING MACHINE WITH A MOVABLE CENTERING AND LOWERING DEVICE FOR INSERTING PARTITIONS BETWEEN GROUPS OF BOTTLES OR CANS AND A METHOD OF OPERATION THEREOF

BACKGROUND

1. Technical Field

The present application relates to a beverage bottling plant for filling, closing, and packing beverage bottles.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

The present application also relates to a method for the manufacture of container packages and for the packing of containers in container carriers, such as outer boxes, covering boxes, or wholesale boxes, for example, as well as a device for the performance of the method. The present application therefore relates in one exemplary embodiment for example to container packages that are in the form of a box-shaped recipient made of a blank of folding flat material with corresponding side walls, whereby the box-shaped recipient can be open on the top. These container packages also have partitions made of an additional blank of folding flat material, which when folded out form corresponding dividers or webs for to protect the containers to be packaged from impacts and to keep them in place during transport.

DE 23 56 319 A1 discloses a method for the opening of folded-up dividers and for the insertion of the opened dividers in container packages, whereby the folded or collapsed divider is set upright into a first position, from which it is advanced by means of a transport device activated by suction force, is thereby opened and transported into a second position above the container, fixed in said second position and finally inserted into the opened container package. During the transfer of the divider from the first position into the second position, the divider is opened by a 90° pivoting of a transverse web of the transport device which is activated by suction force.

The opened divider is then inserted partway into a container package and is finally pushed down to the bottom of the container package by a vertically movable presser or stamp. Apart from the multiple steps required for the insertion of a divider, one additional significant disadvantage is that these steps, which must be carried out one after another, can only be performed with the machine in discontinuous operation.

DE 30 33 773 A1 discloses, among other things, a method for the manufacture of container carriers and for the packing of containers in such container carriers. According to this prior art document, separately manufactured flat blanks for a container carrier and for a set of partition inserts are delivered to a packaging plant. The partition insert, which is either prefabricated or fabricated in the packing plant, is unfolded to form divided fields and is brought together with a group of containers. The unfolded partition insert is placed over the prepared group of containers from above. In practice, the method is carried out so that groups of containers are pushed onto the bottoms of container carrier blanks as the blanks are lying flat, and the dividers with the unfolded transverse webs are then inserted from above between the rows of container groups. The side walls of the container carrier blank are then folded against the long sides of the containers. The end-side connecting straps of the middle walls and the end walls of the container carrier blanks are also folded against the transverse sides of the containers and are glued to one another. The latter action occurs at a right angle to the direction of transport.

The prior art also discloses devices that are designed to remove the spacers between layers, dividers or webs while they are still folded flat, one after another by means of the gripper device of a charging unit, which transports the web in the horizontal direction, opens them and then transfers them to a vertical device, with which the opened webs can be inserted in a box that contains bottles or similar objects. Units of that type have the disadvantage that the webs, which are generally made of cardboard, can be damaged during the transfer from one device to the other. The entire cycle also takes a very long time between the time the web is picked up and inserted into the box, because a certain amount of time is necessary for the horizontal movement for the transport between the devices. Finally, extreme care is necessary to guarantee a correct positioning between the devices for the horizontal and vertical movement, because otherwise the unit must be turned off.

Finally, the prior art also discloses that the setup, conversion and insertion processes can be done in one in continuous operation. For this purpose a device is used for the extraction of a separating insert or of a divider in the flat, folded position and for the opening and insertion of the separating insert or divider into a container package or a box, which device has an individual gripping device with which an L-shaped movement can be executed with the simultaneous opening of each divider and a placement of the divider into the box under the action of gravity. The final bottom position of the dividers positioned between the bottles, cans and similar objects is then achieved by means of vibrator devices or vibrating tables.

One disadvantage of this method is the uncontrolled transfer of a divider, which is simply dropped into place. In particular at high speeds, the dividers repeatedly tip as they fall down onto the formations of bottles, with the resulting disruptions of machine operation.

OBJECT OR OBJECTS

An object is to eliminate the disadvantages cited above, and correspondingly to create a rapid and disruption-free transfer cycle, avoiding damage to the overall packaging material, and a straight and centered placement of the dividers during continuous machine operation. The present application teaches that this object is accomplished by at least one of the embodiments disclosed herein.

SUMMARY

The present application teaches that the dividers, still lying flat, are extracted from the dispenser hopper or cartridge, opened and moved, preferably in the horizontal plane, above the plane of movement of the container group and/or an outer box, and in this position are transferred to a divider centering and lowering device, and from there, as the speed of the dividers is matched to the speed of transport of the container group, the dividers are introduced into the spaces between the containers or into the outer box at least partly by force.

The method and device taught by the embodiments result in a particularly gentle and problem-free transfer of the individual dividers. The webs of the dividers are pre-centered before the actual transfer into the assembly of containers and are then forcibly lowered into place.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Additional features and advantages of the present application are disclosed herein below in the following description, with reference to the accompanying drawings, which show the corresponding exemplary embodiments and in which.

DESCRIPTION OF EMBODIMENT OR EMBODIMENTS

Figure 1:
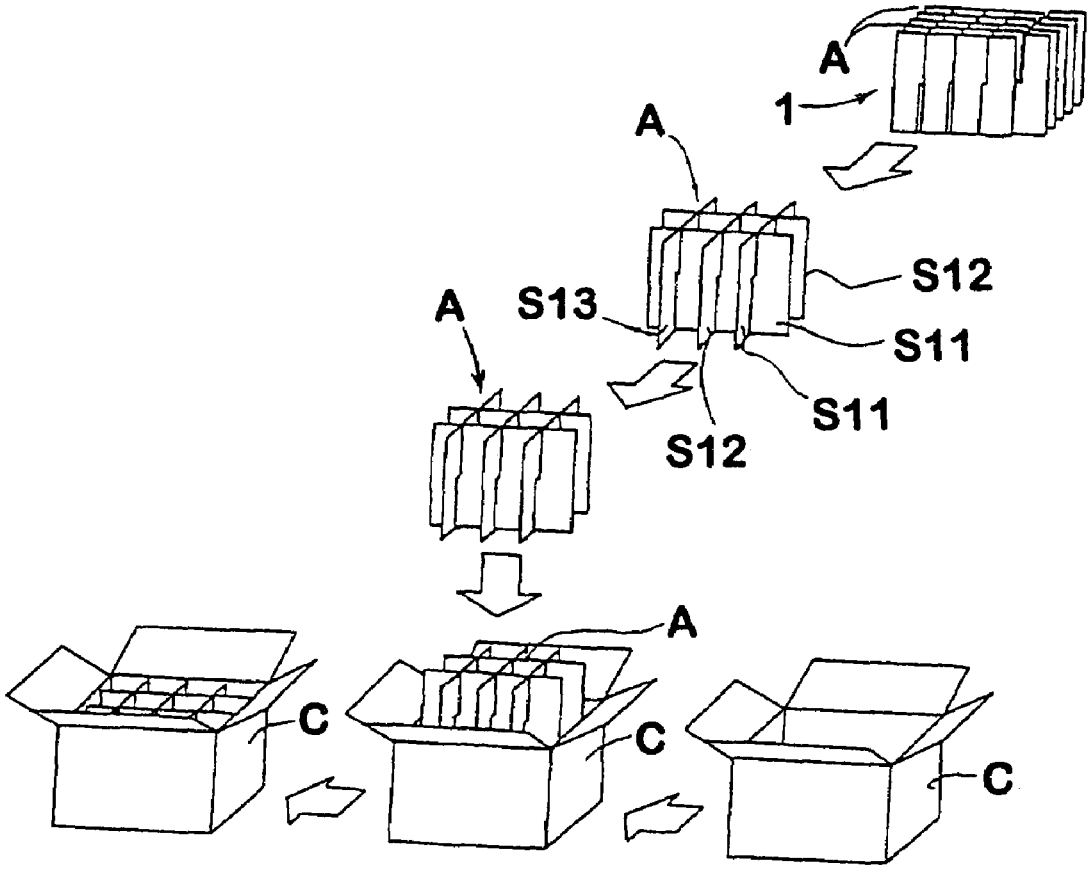
FIG. 1 is a schematic process diagram of a transfer process with the individual steps: extraction, separation and lowering into place of a divider.
Figure 1A:
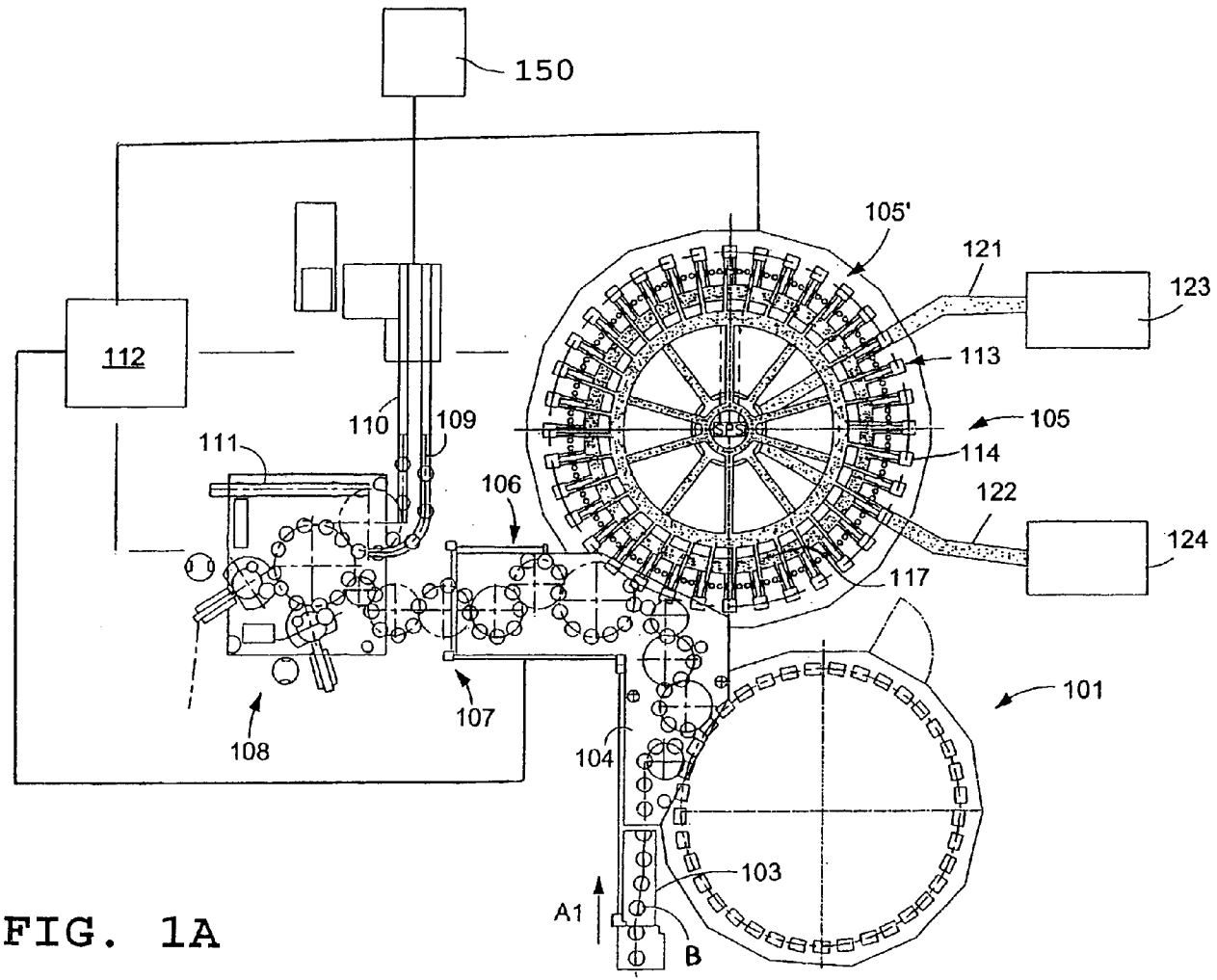
FIG. 1A is a schematic illustration of a container filling plant in accordance with one possible embodiment.

FIG. 1A shows schematically the main components of one embodiment example of a system for filling containers, specifically, an embodiment of a beverage bottling plant 100 for filling bottles B with liquid beverage filling material, in accordance with one embodiment, or in which system or plant could possibly be utilized at least one aspect, or several an aspects, of the embodiments disclosed herein.

FIG. 1A shows a rinsing arrangement or rinsing station 101, to which the containers, namely bottles B, are fed in the direction of travel as is indicated by the arrow A1, by means of a conveyer line or conveyer arrangement to feed bottles to rinsing arrangement 103, and downstream of rinsing arrangement or rinsing station 101, in the direction of travel as is indicated by the arrow A1, the rinsed bottles B are transported to a beverage filling machine 105 by means of a conveyer line or conveyer arrangement 104 to pass bottles to filling machine that is formed, for example, by a starwheel conveyer or a plurality of starwheels of a conveyer arrangement. The conveyer arrangement 104 to pass bottles to filling machine may possibly comprise a starwheel conveying structure that introduces bottles B to the filling machine 105.

Downstream of the filling machine 105, in the direction of travel of the bottles B, there can preferably be a closing arrangement or closing station 106 which closes the bottles B.

The closing arrangement or closing station 106 can, for example, be connected directly to a labeling arrangement or labeling station 108 having at least one labeling unit, device, or module for first product, each unit having a head, such as, for example, by means of a conveyer arrangement 107 to pass bottles to labeling arrangement that may be formed, for example, by a plurality of starwheels of a conveyer arrangement.

In the illustrated embodiment, the labeling arrangement or labeling station 108 having at least one labeling unit, device, or module for first product, each unit having a head has, for example, three outputs, namely one output formed by a conveyer arrangement 109 to convey first product bottles for bottles B that are filled with a first product. The first product may possibly be provided by a first product mixer 123 that is connected to the filling machine 105, for example, through a conduit for first product 121, and bottles B that are filled with a predetermined volume of liquid beverage filling material, that is, the first product, are then labeled by a labeling module in the labeling arrangement or labeling station 108 having at least one labeling unit, device, or module for first product, each unit having a head, corresponding to this first product delivered from first product mixer 123 to the beverage filling machine 105 and thence to the corresponding bottles B.

A second output that is formed by a conveyer arrangement 110 to convey second product bottles is provided for those bottles B that are filled with a second product. The second product may emanate from a second product mixer 124 that is connected, for example, through a conduit for second product 122 to the filling machine 105, and these bottles B filled with a predetermined volume of liquid beverage filling material comprising the second product are then correspondingly labeled by a labeling module in the labeling arrangement or labeling station 108 having at least one labeling unit, device, or module for first product, each unit having a head, corresponding to this second product.

A third output, for example, formed by a conveyer arrangement 111 to convey incorrectly labeled bottles, removes any bottles B which have been incorrectly labeled as may have been determined by an inspecting device or an inspecting station, or an inspecting module that may possibly form a part of the labeling arrangement or labeling station 108 having at least one labeling unit, device, or module for first product, each unit having a head.

After the bottles have been filled, closed, and labeled, the bottles are moved by the conveyor arrangements 109, 110 to a packing or packaging section 150 of the plant. In the packing section 150, the bottles are arranged in groups and transported by a conveyor arrangement. The groups of bottles can either be placed on bottle trays or pallets or in boxes or containers, and then subsequently divided by dividers placed between the individual bottles. Various embodiments of the packing or packaging station that could be used in a beverage bottling plant as shown in FIG. 1A are disclosed herein.

In FIG. 1A item 112 is a central control arrangement or, expressed differently, a controller with a computer to process algorithms, which controls the operation of the above-referenced system or plant.

The beverage filling machine 105 is preferably of the revolving design, with a rotor 105', which revolves around a vertical machine axis. The rotor 105' is designed to handle the bottles B by the neck. A filling arrangement 114 having at least one filling device, element, apparatus, or valve, comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, the filling arrangements 114 having at least one filling device, element, apparatus, or valve, are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of the conduit for first product 121 to the external reservoir or first product mixer 123 to supply the product.

As well as the more typical filling machines having one toroidal vessel, it is possible that in at least one possible embodiment a filling machine could possibly be utilized wherein each filling arrangement 114 having at least one filling device, element, apparatus, or valve is preferably connected by means of two connections to a toroidal vessel 117 which contains a first product, say by means of a first connection, for example, the conduit for first product 121, and to a second toroidal vessel which contains a second product, say by means of the second connection, for example, the conduit for second product 122. In this case, each filling arrangement 114 having at least one filling device, element, apparatus, or valve can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

FIG. 1 shows a schematic process diagram of the transfer process described below. As illustrated, the dividers A are extracted from a dispenser hopper 1 and are stood upright during the transfer and lowered into an outer box C or an assembled group of containers. The dividers thereby preferably describe an L-shaped path of movement, which comprises a first movement segment in a preferably horizontal plane and a second movement segment in a vertical plane. It should be noted that during the movement of the divider in the vertical plane, the divider is simultaneously moved horizontally in the direction of movement of the containers to be divided to match the speed of the containers so the containers do not have to be stopped on their conveyor arrangement.

Figure 2:
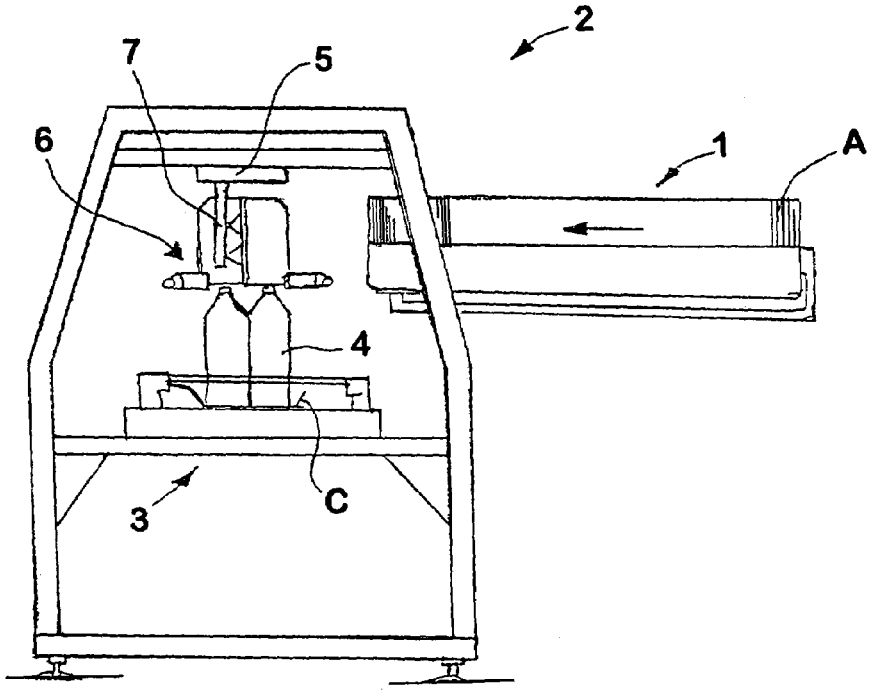
FIG. 2 shows a cross section through a suitable packing machine.
Figure 3:
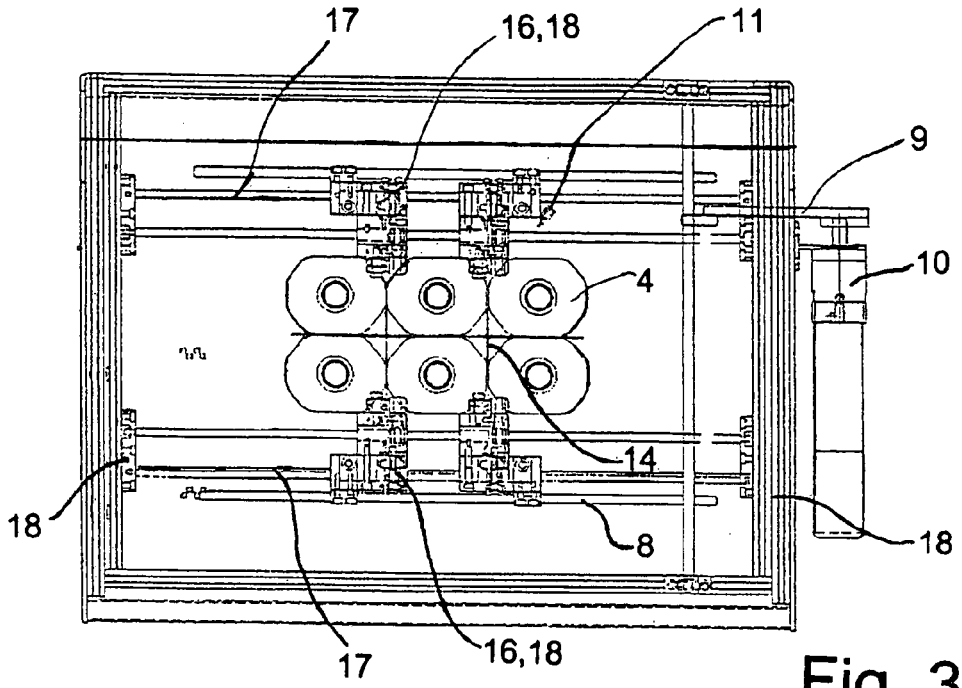
FIG. 3 shows an overhead view of a positioning and feed device.

In the exemplary embodiment illustrated in FIG. 2, the packing machine 2 comprises a bottle, can or container conveyor 3, with which the assembled containers 4 are transported, optionally in an outer box C with high or flat side walls. At right angles and above it runs a dispenser hopper 1 for dividers A that are presented in the lying-flat position. A transfer device 5 can also be moved, preferably in the horizontal plane, between the dispenser hopper 1 and the transfer position above a divider centering and lowering device 6. The dividers A are thereby extracted by means of a vacuum suction device 7, are stood upright or opened as appropriate, and for lowering between the containers 4 and/or into a container package are transferred into the divider centering device 6 by gravity. The divider centering device 6, as shown in FIG. 3, is mounted on a frame 8 that can be moved forward and backward in the direction of transport of the containers 4 so that it can be adjusted to handle different sizes of containers and dividers or dividers with compartments of different sizes. The drive system used is a motor 10 which is effectively connected with the frame 8 by means of a linkage 9. However, other types of drive systems can also be used without problems, such as linear motors, threaded spindle conveyors, linear drives or similar systems.

In the exemplary embodiment illustrated in FIG. 3, the divider centering device 6 is equipped with two lowering units 11, one on each of the facing sides, at the appropriate distance from the divider transverse web.

With regard to the lowering units 11, the present application teaches that they can be easily moved and fixed in position on the frame 8 to promote a fast and easy adaptation of the divider centering and lowering device 6 to handle changing sizes of containers and/or dividers. The present application also teaches that the lowering units 11 can be rapidly installed and removed by suitable constructive measures, such as, for example, the use of quick-release fasteners which are themselves known, so that the divider centering and lowering device 6 can be quickly adjusted to handle dividers with different numbers of transverse webs.

Figure 4:
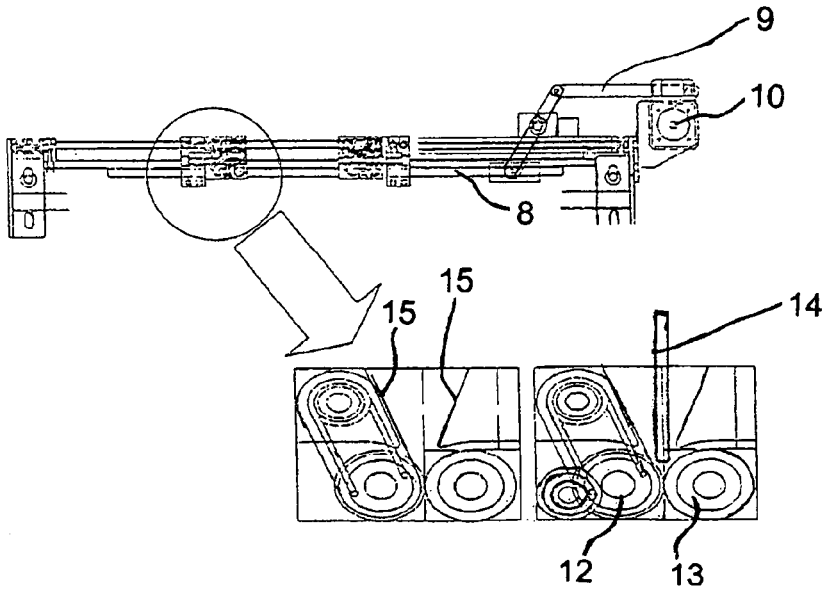
FIG. 4 is an illustration on an enlarged scale of a drive and conveyor unit.

The lowering units 11 illustrated in FIG. 4 have drive means which are realized in the form of a pair of rollers 12, 13 that rotate in opposite directions and that receive a lowered web 14 between them. There are also centering surfaces 15 that run diagonally for the improved introduction of the webs 14 between the rollers 12, 13. One or both of the rollers 12, 13 can be motor-driven and/or mechanically driven. In the illustrated exemplary embodiment, at least one roll of the roller pair 12, 13 can be driven by means of a rack and pinion drive 16. For this purpose, a stationary toothed rack 17 is fastened to the machine frame 8. The rack gear 18 rolls along this toothed rack 17 and thereby drives at least one of the rollers 12 or 13. Taking advantage of the movement of the frame, the rollers 12, 13, are thereby rotated in the direction that lowers the divider during the forward motion of the frame, i.e. in the direction of transport of the assembly of containers, and in the direction that raises the dividers during the reverse movement. During the reverse movement of the frame, the rollers 12, 13 also execute a lifting rotational movement, in the vicinity of the turnaround point and the pickup position of the divider, to effect, instead of the pulling-in of the webs 14, first their correct and uniform positioning between the rollers. In particular as a result of the centering surfaces 15 that run at an angle or diagonally in relation to each other, there is a relatively large opening angle, which makes it possible to insert the dividers or their webs 14 without problems ahead of the turnaround point. Therefore it is not absolutely necessary to locate the transfer point so that it coincides exactly with the turnaround point of the travel. Rather, depending on the opening angle of the centering surfaces, an earlier time can be selected for the optimal centering of the dividers, and can be achieved by shifting the centering units on the frame 8. The present application teaches that at least one of the rollers 12 or 13 of a driven pair of rollers is spring-mounted, preferably with an adjustable application pressure. This measure guarantees on one hand the non-slip lowering of the dividers A and on the other hand the uninterrupted processing of different material thicknesses.

To further explain, in at least one possible embodiment, at least one of the rollers 12, 13 is connected to a gear device 18 that is connected to a stationary toothed structure 17 mounted on the frame 8. As the frame 8 is moved to match the speed and direction of movement of the containers 4 located below the frame 8, the toothed structure 17 moves as well, thereby engaging the gear device 18. The gear device 18 drives and rotates the rollers 12, 13 in a manner to draw in a divider web or section 14 adjacent the rollers 12, 13. For example, as seen in FIG. 4, roller 13 could rotate counter-clockwise and roller 12 could rotate clockwise. This rotation would cause the portions of the rollers 12, 13 adjacent the divider section 14 to draw the section 14 downward in between the rollers 12, 13 to drive the divider into position between the containers 4. In this manner, the motion of the frame 8, which is necessary to keep the divider centering and lowering device 6 above the moving containers 4, is used to power the rollers 12, 13 which drive the divider into position. This method and arrangement essentially eliminates the need for additional drive mechanisms to power the rollers 12, 13. In addition, as the frame 8 and the divider centering and lowering device 6 are moved back (opposite the direction of travel of the containers) to receive another divider, the gear device 18 is engaged by the toothed structure 17 to drive in reverse. As a result, the rollers 12, 13 are rotated opposite to the directions they were previously rotating. The rollers 12, 13 are no longer executing a movement that would cause the drawing downward of the divider web or section 14, thereby preventing the rollers 12, 13 from prematurely gripping and drawing the divider web 14. Any divider section 14 that would come in contact with the rollers 12, 13 during this reverse movement would be driven up and out rather than drawn down and in. Consequently, dividers can be centered and positioned at any time during this reverse or backward movement without concern that the dividers would be fed prematurely or incorrectly. The dividers would not be fed until the frame 8 is moved forward with the containers 4 located below.

In addition, the dividers are moved horizontally as the frame 8 moves, and are simultaneously moved vertically in between the containers 4. This simultaneous horizontal and vertical movement therefore creates in effect an overall diagonal movement of the dividers during insertion. However, with respect to the divider centering and lowering device 6 and the containers 4, the dividers move in essentially only a vertical direction during insertion since the dividers are moving at the same speed and in the same direction as the centering and lowering device 6 and the containers 4.

In at least one possible embodiment, the dividers could be gripped or held by grippers located above the dividers in the vertical plane. In such a configuration, the grippers could be driven down to force the dividers into the desired position.

It should be understood that at least one of the embodiments disclosed herein may be utilized in conjunction with various sizes and types of containers for various products and uses not specifically set forth herein. For example, the method and apparatus for placing dividers in between items, such as beverage bottles, in containers or packages, such as boxes, may be used to place dividers between other items in different containers. In at least one embodiment, dividers could be placed in boxes, cans, canisters, buckets, cases, crates, cartons, or chests. Individual containers, such as bottles, tubes, and small boxes, could be divided and separated in a container by the embodiments of the divider method and apparatus described herein. Such divided containers or cases could be used to hold common supermarket products, such as food products like cereals, snacks, baked goods, recipe ingredients, condiments, soups, jams and jellies, and beverages, and non-food products like medicines, health and beauty products, and household cleaners and supplies. Even the individual packages of these products for sale at a supermarket could have smaller dividers in the packages to divide up individual components of the product, such as packets of different types of the product or individual servings.

One feature or aspect of an embodiment is believed at the time of the filing of this patent application to possibly reside broadly in a method for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, whereby the dividers lying flat are extracted from the dispenser hopper, opened and moved preferably in the horizontal plane above the plane of movement of the container group and/or of an outer box, characterized by the fact that the dividers in this position are transferred to a divider centering and lowering device, and from said device, as their speed is made to match the speed of transport of the container group, are at least partly forcibly inserted into the spaces between the containers and/or into the outer box.

Another feature or aspect of an embodiment is believed at the time of the filing of this patent application to possibly reside broadly in a method for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact that the dividers are forcibly inserted by the divider centering and lowering device at least to a level in the container group in which a secure centering is guaranteed for the final lower positioning.

Yet another feature or aspect of an embodiment is believed at the time of the filing of this patent application to possibly reside broadly in a method for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact that the dividers can be forcibly lowered by the divider centering and lowering device until they reach the final bottom position or a position near the bottom.

Still another feature or aspect of an embodiment is believed at the time of the filing of this patent application to possibly reside broadly in an apparatus for the execution of the method for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, with a conveyor plane for the transport of bottles, cans and similar containers and/or outer boxes to hold such containers, a dispenser hopper that holds the dividers folded flat, and a transfer device that opens the dividers for transfer into the transfer position above the groups of containers that are transported continuously through the machine, characterized by the fact that the transfer device describes a specified path of movement or travel or trajectory and on its end in the vicinity of the transfer position corresponds with a divider centering and lowering device, which has at least one divider centering unit located on each of the facing sides of the transport plane, which centering units can for their part be adjusted to handle different sizes of container groups on a frame that can be moved forward and backward in the direction of travel of the container groups.

A further feature or aspect of an embodiment is believed at the time of the filing of this patent application to possibly reside broadly in a device for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact that the divider centering unit has drive means that receive the vertical webs of a divider and simultaneously form centering means for the divider.

Another feature or aspect of an embodiment is believed at the time of the filing of this patent application to possibly reside broadly in a device for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact that the drive means are realized in the form of a roller pair that rotate in opposite directions and that receive the web in between them.

Yet another feature or aspect of an embodiment is believed at the time of the filing of this patent application to possibly reside broadly in a device for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact the roller pair can be driven so that it transports a divider in the lowering direction when the frame moves in the direction of travel of the container group, and in the lifting direction when the frame moves in the reverse direction.

Still another feature or aspect of an embodiment is believed at the time of the filing of this patent application to possibly reside broadly in a device for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact that at least one roller of the roller pair can be driven mechanically and/or by means of a motor.

A further feature or aspect of an embodiment is believed at the time of the filing of this patent application to possibly reside broadly in a device for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact that at least one roller of the roller pair can be driven forward and backward by means of a rack and pinion drive, utilizing the movement of the frame.

Another feature or aspect of an embodiment is believed at the time of the filing of this patent application to possibly reside broadly in a device for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact that the rollers also execute a lifting rotational movement in the vicinity of the turnaround point and the take-up position for the centering of the inserted dividers during the reverse movement of the frame.

Yet another feature or aspect of an embodiment is believed at the time of the filing of this patent application to possibly reside broadly in a device for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact that at least one roller of a roller pair is spring-mounted and has an adjustable application pressure.

Still another feature or aspect of an embodiment is believed at the time of the filing of this patent application to possibly reside broadly in a device for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact that the transfer device executes only a horizontal travel.

A further feature or aspect of an embodiment is believed at the time of the filing of this patent application to possibly reside broadly in a device for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact that lowering units are fastened to the frame by means of quick-release fasteners.

Another feature or aspect of an embodiment is believed at the time of the filing of this patent application to possibly reside broadly in a device for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, characterized by the fact that lowering units are located so that they can be moved and fixed in position on the frame.

Still another feature or aspect of an embodiment is believed at the time of the filing of this patent application to possibly reside broadly in a method and a device for the manufacture of container packages and for the packing of containers such as bottles, cans and similar items in outer boxes with partition inserts or dividers that can be introduced between the containers and can be extracted from a dispenser hopper and inserted into the spaces in a group or containers or into an outer box, whereby the dividers (A) lying flat are extracted from the dispenser hopper, opened and moved preferably in the horizontal plane above the plane of movement of the container group and/or of an outer box, whereby the dividers (A) in this position are transferred to a divider centering and lowering device (6), and from said device, as they assume the speed of transport of the container group (4), are inserted at least partly forcibly into the spaces between the containers and/or into the outer box.

Yet another feature or aspect of an embodiment is believed at the time of the filing of this patent application to possibly reside broadly in a beverage bottling plant for filling beverage bottles with liquid beverage material, said beverage bottling plant comprising: a beverage bottle cleaning machine being configured and disposed to clean empty beverage bottles; a feed arrangement to supply empty beverage bottles to said beverage bottle cleaning machine; a beverage filling machine being configured and disposed to fill empty beverage bottles with liquid beverage material; said beverage filling machine comprising a plurality of beverage filling devices for filling beverage bottles with liquid beverage material; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move empty beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packaging station being configured and disposed to package labeled, filled, closed beverage bottles; a fourth conveyor arrangement being configured and disposed to move labeled, filled, closed beverage bottles from said beverage bottle labeling machine to said beverage bottle packaging station; said fourth conveyer arrangement comprising a linear conveyor structure being configured and disposed to arrange beverage bottles in groups; and said beverage bottle packaging station comprising: a dispenser hopper being configured and disposed to hold a supply of folded-flat dividers for dividing groups of beverage bottles; a transfer device being configured and disposed to retrieve and open folded-flat dividers from said dispenser hopper; said transfer device being configured and disposed to transfer opened dividers into a transfer position above said linear conveyor; a divider centering and lowering device being configured and disposed to receive opened dividers from said transfer device at the transfer position; said divider centering and lowering device being configured and disposed to be moved forward and backward in the direction of travel of groups of beverage bottles; said divider centering and lowering device comprising a first portion and a second portion disposed opposite said first portion on opposite sides of said linear conveyor; each of said first portion and said second portion comprising at least one centering unit configured and disposed to center an opened divider with respect to a corresponding group of beverage bottles; each of said centering units being adjustable to handle different sizes of groups of beverage bottles; and each of said centering units being configured and disposed to forcibly feed an opened divider into spaces between individual beverage bottles in a corresponding group of beverage bottles to divide the individual beverage bottles.

Another feature or aspect of an embodiment is believed at the time of the filing of this patent application to possibly reside broadly in a method of operating a beverage bottling plant for filling beverage bottles with liquid beverage material, said beverage bottling plant comprising: a beverage bottle cleaning machine being configured and disposed to clean empty beverage bottles; a feed arrangement to supply empty beverage bottles to said beverage bottle cleaning machine; a beverage filling machine being configured and disposed to fill empty beverage bottles with liquid beverage material; said beverage filling machine comprising a plurality of beverage filling devices for filling beverage bottles with liquid beverage material; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move empty beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packaging station being configured and disposed to package labeled, filled, closed beverage bottles; a fourth conveyor arrangement being configured and disposed to move labeled, filled, closed beverage bottles from said beverage bottle labeling machine to said beverage bottle packaging station; said fourth conveyer arrangement comprising a linear conveyor structure being configured and disposed to arrange beverage bottles in groups; and said beverage bottle packaging station comprising: a dispenser hopper being configured and disposed to hold a supply of folded-flat dividers for dividing groups of beverage bottles; a transfer device being configured and disposed to retrieve and open folded-flat dividers from said dispenser hopper; said transfer device being configured and disposed to transfer opened dividers into a transfer position above said linear conveyor; a divider centering and lowering device being configured and disposed to receive opened dividers from said transfer device at the transfer position; said divider centering and lowering device being configured and disposed to be moved forward and backward in the direction of travel of groups of beverage bottles; said divider centering and lowering device comprising a first portion and a second portion disposed opposite said first portion on opposite sides of said linear conveyor; each of said first portion and said second portion comprising at least one centering unit configured and disposed to center an opened divider with respect to a corresponding group of beverage bottles; each of said centering units being adjustable to handle different sizes of groups of beverage bottles; and each of said centering units being configured and disposed to forcibly feed an opened divider into spaces between individual beverage bottles in a corresponding group of beverage bottles to divide the individual beverage bottles, said method comprising the steps of: supplying empty beverage bottles to said beverage bottle cleaning machine; cleaning empty beverage bottles; transporting empty beverage bottles to said beverage filling machine; filling empty beverage bottles with liquid beverage material; transporting filled beverage bottles to said beverage bottle closing machine; closing tops of filled beverage bottles; transporting filled beverage bottles to said beverage bottle labeling machine; attaching labels onto filled beverage bottles; transporting filled beverage bottles to said beverage bottle packaging station; arranging filled beverage bottles into groups of beverage bottles; removing with said transfer device one of said flat dividers from said dispenser hopper; opening the flat divider; moving the opened divider into the transfer position in the divider centering and lowering device above a corresponding group of beverage bottles being transported through said beverage bottle packaging station on said linear conveyor; centering the open divider with respect to the corresponding group of beverage bottles; moving said divider centering and lowering device in the same direction and at essentially the same speed as the direction and speed of transport of the corresponding group of beverage bottles above the corresponding group of beverage bottles; inserting, at least partly forcibly, said divider into the spaces between the beverage bottles of the corresponding group of beverage bottles; moving said divider centering and lowering device in the opposite direction as the direction of transport of the corresponding group of beverage bottles back to the transfer position to receive another divider to divide a subsequent group of beverage bottles; and repeating said steps of retrieving, moving, and inserting the dividers for subsequent groups of beverage bottles.

An example of a packing container sold under the trademark name "Brik-Pak" can be found in U.S. Pat. No. 4,287,247, entitled "Packing laminate provided with crease lines." Machines for assembling and filling the Brik-Pak containers are made by Tetra Pak, Inc. of Vernon Hills, Ill.

The components disclosed in the various publications, disclosed or incorporated by reference herein, may possibly be used in possible embodiments of the present invention, as well as equivalents thereof.

Some examples of partition inserters which may possibly be utilized or adapted for use in at least one possible embodiment may include the ZPI-400 for inserting corrugated partitions made by Moen Industries, 12333 Los Nietos Rd., Santa Fe Springs, Calif. 90670; the SF-400 Partition Inserter by Wayne Automation Corporation, 605 General Washington Ave., Norristown, Pa. 19403; the Model 70 partition opener/inserter by A-B-C Packaging Machine Corporation, 811 Live Oak Street, Tarpon Springs, Fla. 34689; and the YH1400 partition inserter by Pearson Packaging Systems, 8120 West Sunset Highway, Spokane, Wash. 99224. Another example of a partition inserter may possibly be found in U.S. Pat. No. 5,600,936, entitled "Suspended modular partition inserter."

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of shrink wrapping machines or machines for wrapping items in plastic film which may possibly be utilized or adapted for use in at least one possible embodiment may possibly be found in the following U.S. patents: U.S. Pat. No. 6,826,893, entitled "Apparatus for wrapping products with plastic film;" U.S. Pat. No. 6,739,115, entitled "Equipment for wrapping groups of products in plastic film;" U.S. Pat. No. 5,878,555, entitled "Apparatus for wrapping articles in plastic film;" U.S. Pat. No. 5,787,691, entitled "Apparatus for wrapping articles in plastic film;" U.S. Pat. No. 5,519,983, entitled "Shrink wrap packaging system with an ultrasonic side sealer;" U.S. Pat. No. 4,956,963, entitled "Method of sealing a shrink wrap package;" U.S. Pat. No. 4,873,814, entitled "Method of making a shrink wrap package;" and U.S. Pat. No. 4,214,419, entitled "Collating and shrink wrap packaging apparatus."

The appended drawings in their entirety, including all dimensions, proportions and/or shapes in at least one embodiment of the invention, are accurate and are hereby included by reference into this specification.

Some examples of beverage bottling systems which may possibly be utilized or adapted for use in at least one possible embodiment may possibly be found in the following U.S. Patents, and are hereby incorporated by reference as if set forth in their entirety herein: U.S. Pat. No. 6,494,238, entitled "Plant for filling beverage into beverage bottles and other beverage containers having apparatus for replacing remaining air volume in filled beverage bottles or other beverage containers;" U.S. Pat. No. 6,474,368, entitled "Beverage container filling machine, and method for filling containers with a liquid filling material in a beverage container filling machine;" U.S. Pat. No. 6,470,922, entitled "Bottling plant for bottling carbonated beverages;" U.S. Pat. No. 6,463,964, entitled "Method of operating a machine for filling bottles, cans or the like beverage containers with a beverage, and a beverage container filling machine;" U.S. Pat. No. 6,374,575, entitled "Bottling plant and method of operating a bottling plant;" U.S. Pat. No. 6,365,054, entitled "Plant for filling containers and a method for operating a plant for filling containers," U.S. Pat. No. 6,192,946, entitled "Bottling system;" U.S. Pat. No. 6,189,578, entitled "Filling system and filling element;" U.S. Pat. No. 6,058,985, entitled "Bottling machine with a set-up table and a set-up table for a bottling machine and a set-up table for a bottle handling machine;" U.S. Pat. No. 5,713,403, entitled "Method and system for filling containers with a liquid filling product, and filling machine and labelling device for use with this method or system," U.S. Pat. No. 5,634,500, entitled "Method for bottling a liquid in bottles or similar containers;" and U.S. Pat. No. 5,413,153, entitled "Container filling machine for filling open-top containers, and a filler valve therefor."

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

Some examples of servo-motors that may possibly be utilized or possibly adapted for use in at least one possible embodiment of the present application may possibly be found in the following U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025,684 issued to Yasui on Feb. 15, 2000.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

All of the patents, patent applications and publications recited herein, and in the Declaration attached hereto, are hereby incorporated by reference as if set forth in their entirety herein.

Some examples of servo-motors that may possibly be utilized or possibly adapted for use in at least one possible embodiment of the present application may possibly be found in the following U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of starwheels which may possibly be utilized or adapted for use in at least one possible embodiment may possibly be found in the following U.S. patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of centering devices for bottle handling devices which may possibly be utilized or adapted for use in at least one possible embodiment may possibly be found in Federal Republic of Germany Application No. DE P 103 14 634, entitled "Spülbares Huborgan" having inventor Herbert Bernhard, and its U.S. equivalent, having Ser. No. 10/813, 657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüllmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004 and having Attorney Reference No. NHL-HOL-72. The above applications are hereby incorporated by reference as if set forth in their entirety herein.

The corresponding foreign and international patent publication applications, namely, Federal Republic of Germany Patent Application No. 103 59 310.1, filed on Dec. 17, 2003, having inventors Robert van den Heuvel, Hans-Peter Kuhlmann, Lothar Wess, and Thomas Nitsch, and DE-OS 103 59 310.1 and DE-PS 103 59 310.1, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of synchronous motors which may possibly be utilized or adapted for use in at least one possible embodiment may possibly be found in the following U.S. patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A beverage bottling plant for filling beverage bottles with liquid beverage material, said beverage bottling plant comprising:

a beverage bottle cleaning machine being configured and disposed to clean empty beverage bottles;

a feed arrangement to supply empty beverage bottles to said beverage bottle cleaning machine;

a beverage filling machine being configured and disposed to fill empty beverage bottles with liquid beverage material;

said beverage filling machine comprising a plurality of beverage filling devices for filling beverage bottles with liquid beverage material;

at least one storage unit being configured and disposed to store a supply of liquid beverage material;

at least one supply line being configured and disposed to connect said at least one storage unit to said beverage filling machine to supply liquid beverage material to said beverage filling machine;

a first conveyer arrangement being configured and disposed to move empty beverage bottles from said beverage bottle cleaning machine into said beverage filling machine;

said first conveyer arrangement comprising a star wheel structure;

a beverage bottle closing machine being configured and disposed to close tops of filled beverage bottles;

a second conveyer arrangement being configured and disposed to move filled beverage bottles from said beverage filling machine into said beverage bottle closing machine;

said second conveyer arrangement comprising a star wheel structure;

a beverage bottle labeling machine being configured and disposed to label filled, closed beverage bottles;

a third conveyor arrangement being configured and disposed to move filled, closed beverage bottles from said beverage bottle closing machine into said beverage bottle labeling machine;

said third conveyer arrangement comprising a star wheel structure;

a beverage bottle packaging station being configured and disposed to package labeled, filled, closed beverage bottles;

a fourth conveyor arrangement being configured and disposed to move labeled, filled, closed beverage bottles from said beverage bottle labeling machine to said beverage bottle packaging station;

said fourth conveyer arrangement comprising a linear conveyor structure being configured and disposed to arrange beverage bottles in groups; and said beverage bottle packaging station comprising:

a dispenser hopper being configured and disposed to hold a supply of folded-flat dividers for dividing groups of beverage bottles;

a transfer device being configured and disposed to retrieve and open folded-flat dividers from said dispenser hopper;

said transfer device being configured and disposed to transfer opened dividers into a transfer position above said linear conveyor;

a divider centering and lowering device being configured and disposed to receive opened dividers from said transfer device at the transfer position;

said divider centering and lowering device being configured and disposed to be moved forward and backward in the direction of travel of groups of beverage bottles;

said divider centering and lowering device comprising a first portion and a second portion disposed opposite said first portion on opposite sides of said linear conveyor;

each of said first portion and said second portion comprising at least one centering unit configured and disposed to center an opened divider with respect to a corresponding group of beverage bottles;

each of said centering units being adjustable to handle different sizes of groups of beverage bottles; and each of said centering units being configured and disposed to forcibly feed an opened divider into spaces between individual beverage bottles in a corresponding group of beverage bottles to divide the individual beverage bottles.

2. The beverage bottling plant according to claim 1, wherein each of said divider centering units comprises drive means configured to receive the vertical webs of a divider and simultaneously form centering means for centering the divider.

3. The beverage bottling plant according to claim 2, wherein each of said drive means comprises a pair of rollers configured and disposed to rotate in opposite directions and to receive the web of a divider in between said pair of rollers.

4. The beverage bottling plant according to claim 3, wherein:

said pair of rollers are configured to be driven to transport a divider in a lowering direction upon said divider centering and lowering device being moved in a forward direction along the direction of travel of a group of containers; and said pair of rollers are configured to be driven to transport a divider in a lifting direction upon said divider centering and lowering device being moved in a reverse direction opposite the direction of travel of a group of containers.

5. The beverage bottling plant according to claim 4, wherein at least one roller of said pair of rollers is configured to be driven mechanically and/or by means of a motor.

6. The beverage bottling plant according to claim 5, wherein at least one roller of said pair of rollers is configured to be driven forward and backward by a rack and pinion drive utilizing the movement of said divider centering and lowering device.

7. The beverage bottling plant according to claim 6, wherein:

said pair of rollers are configured to be driven to transport a divider in the lifting direction upon said divider centering and lowering device being moved in the reverse direction to permit centering of the divider in said divider centering and lowering device prior to said divider centering and lowering device being moved in the forward direction to transport the divider in the lowering direction into a group of containers;

at least one roller of said pair of rollers is spring-mounted and has an adjustable application pressure; and said transfer device executes only a horizontal travel.

8. The beverage bottling plant according to claim 7, wherein:

said divider centering and lowering device comprises a frame;

said centering units are fastened to said frame by quick-release fasteners; and said centering units are configured to be moved and fixed in position on said frame.

9. A method of operating a beverage bottling plant for filling beverage bottles with liquid beverage material, said beverage bottling plant comprising: a beverage bottle cleaning machine being configured and disposed to clean empty beverage bottles; a feed arrangement to supply empty beverage bottles to said beverage bottle cleaning machine; a beverage filling machine being configured and disposed to fill empty beverage bottles with liquid beverage material; said beverage filling machine comprising a plurality of beverage filling devices for filling beverage bottles with liquid beverage material; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move empty beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling machine being configured and disposed to label filled, closed beverage bottles; a third conveyor arrangement being configured and disposed to move filled, closed beverage bottles from said beverage bottle closing machine into said beverage bottle labeling machine; said third conveyer arrangement comprising a star wheel structure; a beverage bottle packaging station being configured and disposed to package labeled, filled, closed beverage bottles; a fourth conveyor arrangement being configured and disposed to move labeled, filled, closed beverage bottles from said beverage bottle labeling machine to said beverage bottle packaging station; said fourth conveyer arrangement comprising a linear conveyor structure being configured and disposed to arrange beverage bottles in groups; and said beverage bottle packaging station comprising: a dispenser hopper being configured and disposed to hold a supply of folded-flat dividers for dividing groups of beverage bottles; a transfer device being configured and disposed to retrieve and open folded-flat dividers from said dispenser hopper; said transfer device being configured and disposed to transfer opened dividers into a transfer position above said linear conveyor; a divider centering and lowering device being configured and disposed to receive opened dividers from said transfer device at the transfer position; said divider centering and lowering device being configured and disposed to be moved forward and backward in the direction of travel of groups of beverage bottles; said divider centering and lowering device comprising a first portion and a second portion disposed opposite said first portion on opposite sides of said linear conveyor; each of said first portion and said second portion comprising at least one centering unit configured and disposed to center an opened divider with respect to a corresponding group of beverage bottles; each of said centering units being adjustable to handle different sizes of groups of beverage bottles; and each of said centering units being configured and disposed to forcibly feed an opened divider into spaces between individual beverage bottles in a corresponding group of beverage bottles to divide the individual beverage bottles, said method comprising the steps of:

supplying empty beverage bottles to said beverage bottle cleaning machine;

cleaning empty beverage bottles;

transporting empty beverage bottles to said beverage filling machine;

filling empty beverage bottles with liquid beverage material;

transporting filled beverage bottles to said beverage bottle closing machine;

closing tops of filled beverage bottles;

transporting filled beverage bottles to said beverage bottle labeling machine;

attaching labels onto filled beverage bottles;

transporting filled beverage bottles to said beverage bottle packaging station;

arranging filled beverage bottles into groups of beverage bottles;

removing with said transfer device one of said flat dividers from said dispenser hopper;

opening the flat divider;

moving the opened divider into the transfer position in the divider centering and lowering device above a corresponding group of beverage bottles being transported through said beverage bottle packaging station on said linear conveyor;

centering the open divider with respect to the corresponding group of beverage bottles;

moving said divider centering and lowering device in the same direction and at essentially the same speed as the direction and speed of transport of the corresponding group of beverage bottles above the corresponding group of beverage bottles;

inserting, at least partly forcibly, said divider into the spaces between the beverage bottles of the corresponding group of beverage bottles;

moving said divider centering and lowering device in the opposite direction as the direction of transport of the corresponding group of beverage bottles back to the transfer position to receive another divider to divide a subsequent group of beverage bottles; and repeating said steps of retrieving, moving, and inserting the dividers for subsequent groups of beverage bottles.

10. The method of operating a beverage bottling plant for filling beverage bottles with liquid beverage material according to claim 9, wherein the dividers are forcibly inserted by the divider centering and lowering device at least to a level in the groups of beverage bottles in which a secure centering is essentially guaranteed for the final lower positioning.

11. The method of operating a beverage bottling plant for filling beverage bottles with liquid beverage material according to claim 9, wherein the dividers can be forcibly lowered by the divider centering and lowering device until they reach the final bottom position or a position near the bottom.

12. An apparatus for the manufacture of container packages and for the packing of containers in outer boxes with partition inserts or dividers that can be introduced between the containers and inserted into the spaces in a group of containers or into an outer box, with a conveyor plane for the essentially continuous transport of such containers and/or outer boxes to hold such containers, said packaging apparatus comprising:

a dispenser hopper being configured and disposed to hold a supply of folded-flat dividers for dividing groups of containers;

a transfer device being configured and disposed to retrieve and open folded-flat dividers from said dispenser hopper;

said transfer device being configured and disposed to transfer opened dividers into a transfer position above said linear conveyor;

a divider centering and lowering device being configured and disposed to receive opened dividers from said transfer device at the transfer position;

said divider centering and lowering device being configured and disposed to be moved forward and backward in the direction of travel of groups of containers;

said divider centering and lowering device comprising a first portion and a second portion disposed opposite said first portion on opposite sides of said linear conveyor;

each of said first portion and said second portion comprising at least one centering unit configured and disposed to center an opened divider with respect to a corresponding group of containers;

each of said centering units being adjustable to handle different sizes of groups of containers; and each of said centering units being configured and disposed to forcibly feed an opened divider into spaces between individual containers in a corresponding group of containers to divide the individual containers.

13. The packaging apparatus according to claim 12 wherein each of said divider centering units comprises drive means configured to receive the vertical webs of a divider and simultaneously form centering means for centering the divider.

14. The packaging apparatus according to claim 13, wherein each of said drive means comprises a pair of rollers configured and disposed to rotate in opposite directions and to receive the web of a divider in between said pair of rollers.

15. The packaging apparatus according to claim 14, wherein:

said pair of rollers are configured to be driven to transport a divider in a lowering direction upon said divider centering and lowering device being moved in a forward direction along the direction of travel of a group of containers; and said pair of rollers are configured to be driven to transport a divider in a lifting direction upon said divider centering and lowering device being moved in a reverse direction opposite the direction of travel of a group of containers.

16. The packaging apparatus according to claim 15, wherein at least one roller of said pair of rollers is configured to be driven mechanically and/or by means of a motor.

17. The packaging apparatus according to claim 16, wherein at least one roller of said pair of rollers is configured to be driven forward and backward by a rack and pinion drive utilizing the movement of said divider centering and lowering device.

18. The packaging apparatus according to claim 17, wherein said pair of rollers are configured to be driven to transport a divider in the lifting direction upon said divider centering and lowering device being moved in the reverse direction to permit centering of the divider in said divider centering and lowering device prior to said divider centering and lowering device being moved in the forward direction to transport the divider in the lowering direction into a group of containers.

19. The packaging apparatus according to claim 18, wherein:

at least one roller of said pair of rollers is spring-mounted and has an adjustable application pressure; and said transfer device executes only a horizontal travel.

20. The packaging apparatus according to claim 19, wherein:

said divider centering and lowering device comprises a frame;

said centering units are fastened to said frame by quick-release fasteners; and said centering units are configured to be moved and fixed in position on said frame.

* * * * *